United States Patent [19]

Brochand

[11] Patent Number: 4,784,065

[45] Date of Patent: Nov. 15, 1988

[54] CHAIR-LIFT WITH AUTOMATIC CONTROL OF THE CHAIR PROTECTIVE DEVICES

[75] Inventor: Max Brochand, Noyarey, France

[73] Assignee: Pomagalski S.A., Fontaine, France

[21] Appl. No.: 24,089

[22] Filed: Mar. 10, 1987

[30] Foreign Application Priority Data

Apr. 15, 1986 [FR] France ..... 86 05496

[51] Int. Cl.[4] ..... B61B 11/00

[52] U.S. Cl. ..... 104/173.2; 105/149.2

[58] Field of Search ..... 104/28, 173.1, 173.2; 105/149.1, 149.2

[56] References Cited

U.S. PATENT DOCUMENTS

| | | | |
|---|---|---|---|
| 2,662,587 | 12/1953 | McIlvaine | 104/173.2 |
| 3,008,761 | 11/1961 | McIlvaine | 104/173.2 |
| 3,347,173 | 10/1967 | Carlevaro | 104/173.2 |
| 3,461,813 | 8/1969 | McIlvaine | 104/173.2 |
| 3,556,014 | 1/1971 | Rudkin | 104/173.2 |
| 3,596,612 | 8/1971 | Sowder | 104/173.2 |
| 3,747,974 | 7/1973 | Tauzin | 105/149.2 |
| 4,149,471 | 4/1979 | Tauzin et al. | 104/173.2 |

FOREIGN PATENT DOCUMENTS

| | | | |
|---|---|---|---|
| 2914001 | 10/1979 | Fed. Rep. of Germany | 105/149.2 |
| 1376569 | 9/1964 | France | 105/149.2 |
| 2440014 | 10/1978 | France . | |

*Primary Examiner*—George L. Walton

*Attorney, Agent, or Firm*—Parkhurst, Oliff & Berridge

[57] ABSTRACT

The opening and closing control system of a protective hood of a chair of a chair-lift comprises spring or gravity energy storage devices, to move the hood independently from the speed of the chair. The energy storage device is reloaded when the chair passes through the terminal and catches lock the hood in different positions. These catches are automatically controlled when the chair passes predetermined locations to achieve automatic control of opening and closing of the hood.

11 Claims, 4 Drawing Sheets

CHAIR-LIFT WITH AUTOMATIC CONTROL OF THE CHAIR PROTECTIVE DEVICES

BACKGROUND OF THE INVENTION

The invention relates to a chair-lift having chairs coupled on the line to an aerial rope and equipped with a swing-back protective hood, capable of occupying selectively two positions, a lowered closed position protecting the passengers seated on the chair, and a raised open position for the passengers to mount and dismount from said chair, the hood opening operation being performed at the entry to the terminal and the closing operation at the exit from the terminal.

A chair lift of the kind mentioned enables passengers to be transported in enclosures sheltered from bad weather conditions, while at the same time preserving a notably simpler structure than that of cable-cars. The skiers can in addition keep their skis on, which makes mounting and dismounting operations onto and off the chair easier.

On a state of the art chair-lift, the hood, in the form of a fold-away cover, is fitted in position and removed by the skier or skiers seated on the chair, but these operations require a certain dexterity, notably when it is windy. If the hood is made up of a rigid half-shell, it is practically impossible for the skier to actuate the latter and it has already been proposed that an automatic control similar to that of the cable-car doors be used, wherein a control roller cooperates with a fixed rail extending along the trajectory of the car or the chair. Operation of this positive control is sharp and it cannot be used when the chair is moving quickly, as the length of the control rail becomes too great.

SUMMARY OF THE INVENTION

The object of the present invention is to achieve a chair-lift with automatic control of opening and/or closing of the chair protective hoods, without any risk or accidents or incidents.

The chair-lift according to the invention is characterized by the fact that the chair comprises a first energy storage device, notably a gravity or spring device, to move the hood from one of said positions to the other and a first catch inhibiting the action of said first energy storage device to hold the hood in said one position, said first catch being able to be unlatched to trigger an automatic movement of the hood to said other position due to the action of said first energy storage device, independently of the speed of the chair.

Only the triggering of the hood opening or closing operation is controlled positively, the movement being brought about by the energy storage device, for example by a spring or a counter-weight with a suitable brake or damping system. This movement is totally independent of the speed of travel of the chair and it may take place when the chair is moving quickly, notably on a non-detachable chair-lift. If the chairs are detachable in the terminal, operation of the hood may take place either during the slow movement through the terminal or the fast movement on the line, in this instance just before entry to and just after exit from the terminal.

Reloading of the energy storage device takes place in the terminal during the slow movement of the chair, this reloading being able to be achieved by means of an external energy supply, notably a jack, or be derived from the movement of the chair by a rail or a cam actuating a roller when the chair passes.

According to an alternative embodiment of the invention, both the movements of the hood, respectively opening and closing, are brought about by energy storage devices, which may be the same energy storage device, arranged for two successive control operations without intermediate reloading, or preferably two distinct storage devices. In the latter case, it is advantageous to arrange that reloading of one of the energy storage devices be performed by the movement caused by the other energy storage device, to avoid using two extrinsic reloading systems. If the energy storage devices are weights, it is sufficient that one of the weights be heavier than the other, for example the hood opening weight, to raise the weight controlling closing by opening of the hood. One of the weights can be constituted by the hood itself, the pivoting axis of which is chosen in such a way as to have in any position a moment urging the hood to one of the extreme positions, for example the closed position. In order to avoid automatic closing of the hood when the opening weight is reloaded, a second catch must be provided, which when released triggers closing of the hood at the required moment.

A third safety catch is advantageously fitted to avoid any untimely opening of the hood on the line, notably by the passenger seated on the chair. Release of this safety catch is also automatic and must take place before unlocking of the catch triggering opening of the hood, these successive unlockings being able to be controlled by the same device or by different devices.

The two energy storage devices may be mechanical or hydraulic springs with opposing forces of action, one of which is preponderant, or one of the storage devices may be a spring and the other a weight, any combination being conceivable.

The chair generally speaking comprises a guard-rail operated by the passenger, but it is advantageous to derive the control of the guard-rail from that of the hood to avoid any error. To this end, the guard-rail has only one stable balanced position, preferably the open position, and a stop engaged by the hood in the course of its closing to move the guard-rail to the closed position. It is clear that operation of the guard-rail may be totally or partially independent from that of the hood.

The controls according to the invention operate independently from the occupation of the chair and the hood is always closed on the line and open in the terminal. During certain periods, notably spells of fine weather, the hoods can remain open quite simply by removing or neutralizing the closing catch control device.

Reloading is accomplished by a control device in proximity to the gripping point on the rope in order to avoid nuisance reactions and swinging of the chair during this operation. This control device is easily adaptable to the different types of chairs, notably by modification or by a suitable choice of the force of the energy storage devices.

BRIEF DESCRIPTION OF THE DRAWINGS

Other advantages and characteristics will become more clearly apparent from the following description of an embodiment of the invention, given as a non-limiting example only, and represented in the accompanying drawings, in which.

DETAILED DESCRIPTION

Figure 1:
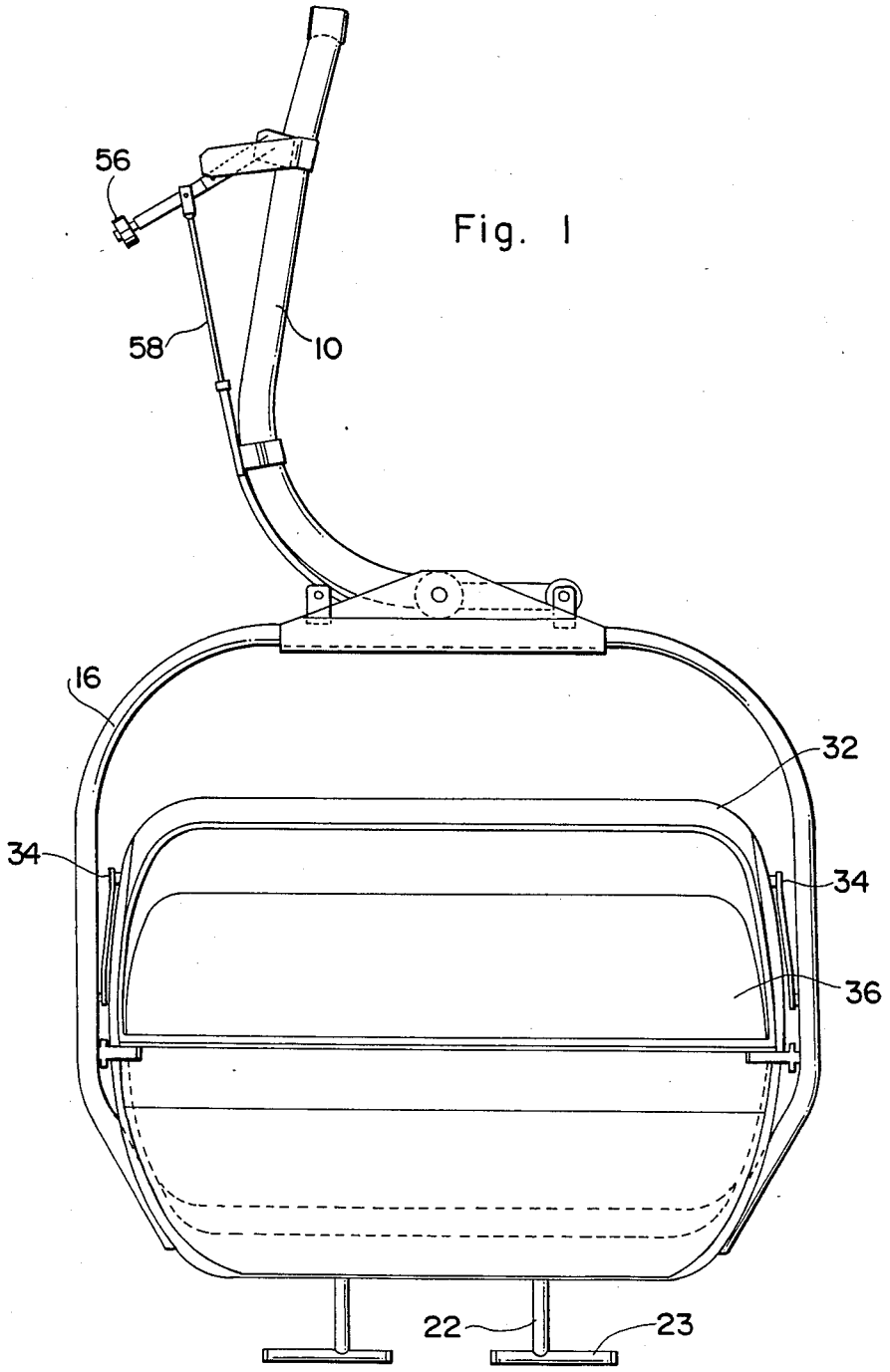
FIG. 1 is a schematic front view of a chair equipped with a hood and with a control device according to the invention.

In the figures, a hanger arm 10 of a chair is coupled to a carrier-hauling rope 12 of a chair-lift by a detachable grip 14, the invention naturally being applicable to a chair-lift with a non-detachable chair. The hanger arm 10 supports a metal frame 16 of a transverse chair 18 with a back-rest 20, facing the direction of travel. A guard-rail 22, with a foot-rest 23, is articulated at a point 24 at the rear of the back-rest 20 and is biased to the open position, represented in FIG. 5, by a tension spring 26 and/or a counterweight 28. The chair 18 is housed inside a shell made up of two half-shells 30, 32, one of which 30 is fixed and securedly united to the frame 16 and the other movable one of which 32 is pivotally mounted on a transverse axis 34, to occupy selectively a closed position (FIG. 2) and an open position (FIG. 5) of the shell. In the closed or lowered position of the movable half-shell 32, the shell constitutes an enclosure protecting the passengers seated on the chair 18, this enclosure being fully or partially closed. In the example illustrated by the figures, the fixed half-shell 30 is open at the base to leave clearance for the feet resting on the foot-rest 23. It is clear that the invention can be applied to a chair not fitted with the fixed half-shell 30, the half-shell 32 then being a simple hood, whose shape or make-up may be different, protecting the passengers. The shell is advantageously made of stratified plastic material with a windshield 36 at the front. In the raised position of the movable half-shell 32, the passengers can mount or dismount from the chair 18 without being hampered by the shell. Chairs of this kind with a protective shell or hood are well known to those skilled in the art and it is unnecessary to describe them in further detail here.

Figure 5:
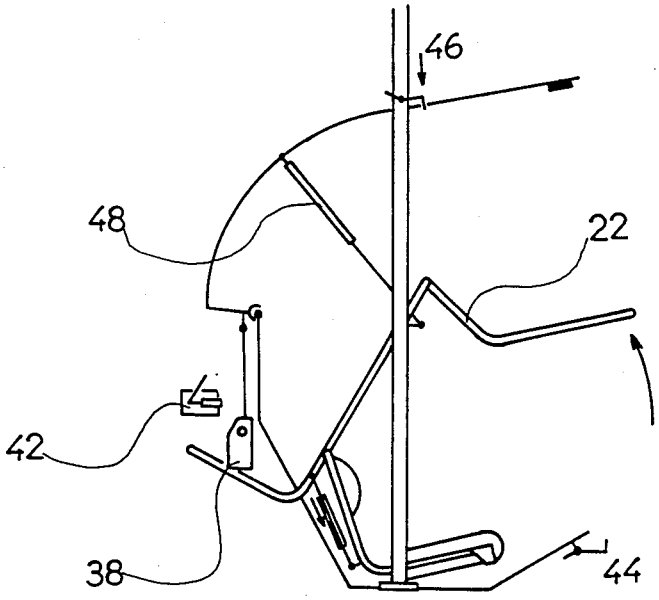

According to the invention, a counterweight 38 is suspended by a flexible link 39 to a lever 40 securedly fixed to the movable half-shell 32, in such a way as to bias this half-shell 32 to the raised position, represented in FIG. 5. In the raised or loaded position of the counterweight 38, the shell is closed and a closing catch 42 engages under the counterweight 38 to lock it in this raised position. When the catch 42 is freed, the counterweight 38 causes the movable half-shell 32 to swing upwards by gravity, the counterweight moving to the lower position (FIG. 5). The center of gravity of the movable half-shell 32 is shifted, with respect to the articulation axis 34, to the right in FIG. 2, so as to urge the half-shell 32 clockwise towards the closed position by gravity in all positions. This closing force can naturally be achieved or increased by a counterweight or a spring acting on the movable half-shell 32. A safety catch 44 operates in conjunction with the half-shell 32 to keep it closed, whereas an opening catch is arranged to hold it in the open position. A damper 48 fixed to the frame 16 dampens the movements of the movable half-shell 32 on closing and/or on opening to prevent any sharp impacts. The catches 42, 46, shaped as tilting or sliding hooks, which latch automatically, have a tail-piece 50 capable of operating in conjunction with a cam or a stop located on the trajectory of the chair travel to make the hook 42, 46 pivot to the unlocked position when the chair passes and to respectively trigger the opening and closing operation of the shell. The catch 44 is advantageously of the bistable type with positive locking and unlocking control by means of a stop 52. It should be noted that other types of catches may be used and that the control means may be different.

Reloading the counterweight 38 is accomplished in a similar manner by a cam 54, which engages a roller 56 securedly fixed or coupled to the counterweight 38 to lift the latter when the chair passes, to bring it to the raised loaded position, in which it is held by the catch 42 which latches automatically. It is advantageous to locate the roller 56 in proximity to the grip 14 attaching the chair to the rope 12 and to transmit the loading movement to the counterweight 38 by means of a mechanism, for example a bowden cable 58. A similar operating means is conceivable for the catches 42, 44, 46. If the energy storage system is a mechanical or hydraulic spring, reloading is performed in the same way by shifting the attachment point. A hydraulic or electric jack fixed or borne by the chair receiving an external energy supply in the reloading area can also be used to perform this operation.

Figure 2:
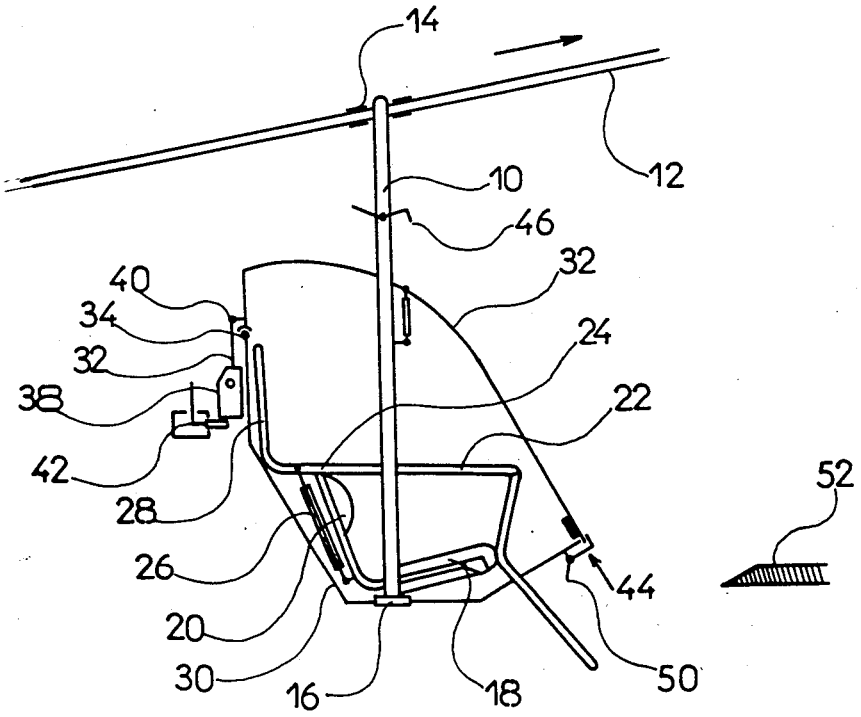
FIG. 2 is a schematic side view of the chair on the line, with the hood closed and the control device loaded.
Figure 3:
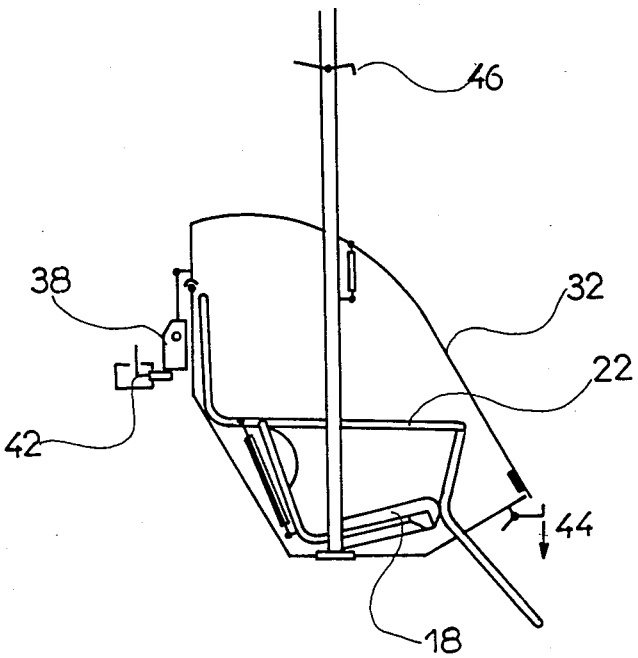
FIGS. 3, 4 and 5 are similar views to that of FIG. 2, illustrating the different phases of an opening operation, respectively opening of the safety catch, opening of the opening catch and latching in the open position.
Figure 4:
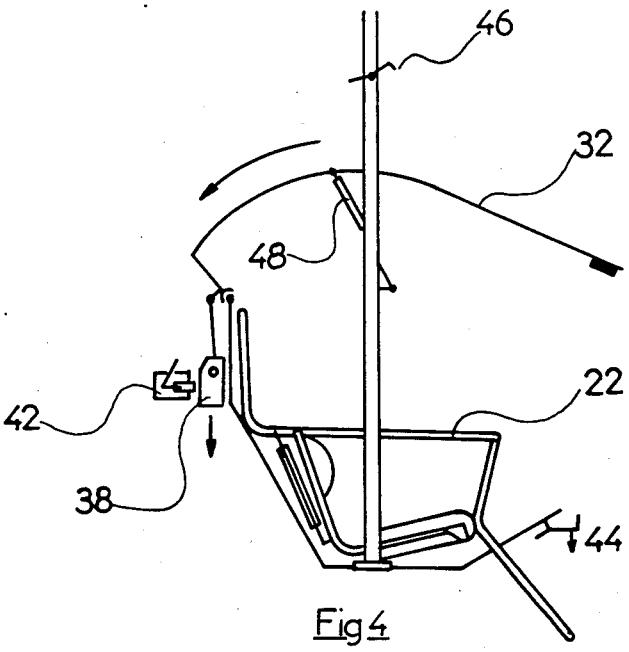
Figure 6:
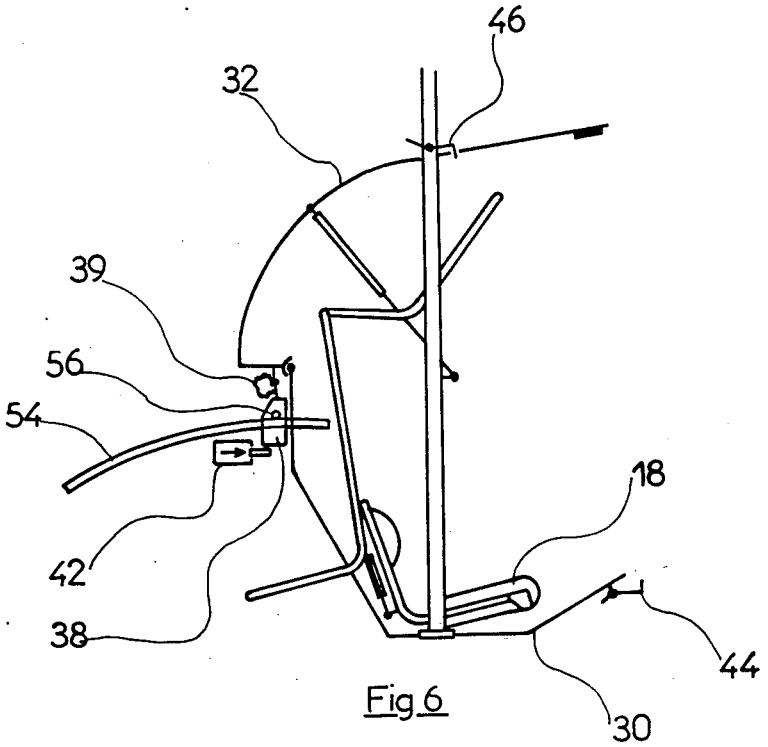
FIGS. 6 and 7 are similar views to that of FIGS. 2 to 5, showing the reloading and hood closing operation.
Figure 7:
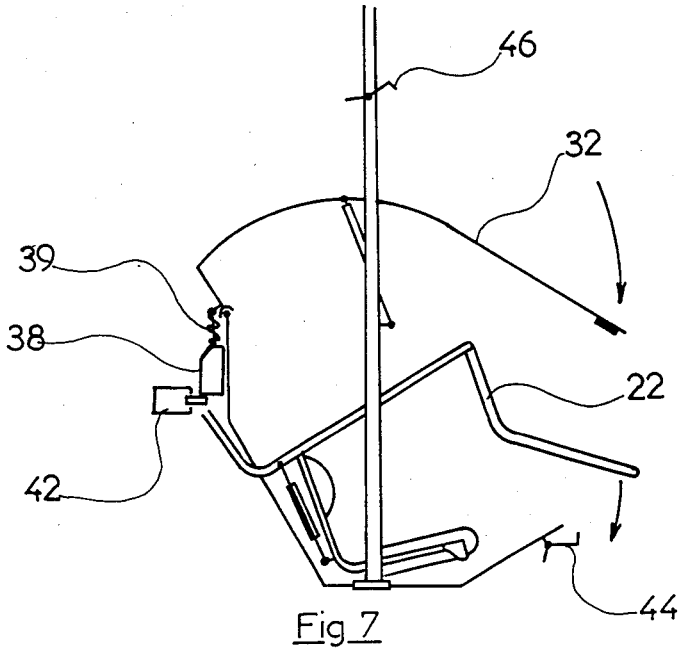

Control of the opening and closing of the shell is performed in the following way:

On the line the shell is closed and the movable half-shell 32 is held in this position by its weight with safety latching by means of the catch 44, which prevents the passengers from raising the half-shell 32. The counterweight 38 is raised and held by the catch 42 (FIG. 2). When the chair approaches a terminal, a cam 52, located along the trajectory, makes the catch 44 pivot to the open position, the shell remaining provisionally closed due to the action of its weight (FIG. 3). Opening of the shell by the movable half-shell swinging upwards 32 takes place a little later when the catch 42 is unlocked by an operating cam which releases the counterweight 38 (FIG. 4). The latter brings the movable half-shell 32 into the open position with latching of the catch 46 (FIG. 5). The guard-rail 22 follows the movement of the half-shell 32 by gravity or due to the action of the spring 26, and the passengers can dismount from or mount on the chair. Reloading of the counterweight 38 is accomplished, during the travel of the chair in the terminal, by the cam 54 which moves the roller 56 to raise the counterweight 38. The half-shell 32 locked by the catch 46 remains open, the flexible link 39 allowing the reloading movement (FIG. 6). Closing of the half-shell 32 is triggered by the release of the catch 46 which allows the half-shell 32 to swing down into the closed position by gravity (FIG. 7). Locking by the catch 44 takes place a little later. The guard-rail 22 has previously been closed by the passengers in the usual manner or otherwise the movable half-shell 32 draws the guard-rail down by its swinging movement and closes it. It can easily be understood that all these operations are automatic, any human error being excluded. The force of the counterweight 38 is greater than the weight of the movable half-shell 32, so as to store the energy for closing this half-shell during the opening operation by means of the action of the counterweight 38. The active forces may vary with the position of the half-shell 32 to avoid any sharp impacts, the movements being in addition dampened by the damper 48. The operating speeds are completely independent of the speed of the chair. The counterweight 38 can also control closing of the shell and two energy storage systems can be fitted each having its own reloading device or having a common device. The guard-rail 22 can be eliminated or incorporated in the half-shell 32, the safety catch 44 not being indispensable.

The operating cycle described above is independent of the type of chair-lift, but the locations where these operations are triggered vary with the installations, the only obligations being the opening of the shell for the passengers to mount and dismount and reloading during the travel in the terminal. In a chair-lift with fixed grips, it is clear that the shell must be opened before or upon entry of the chair in the terminal and closed on exit. In a detachable chair-lift, the control system according to the invention allows operations to be performed while the chair is moving at great speed, for the movement of the movable half-shell 32 is independent of this speed. The shell can thus be opened and closed as for a fixed chair-lift before entering and after leaving the terminal or according to a preferred embodiment after the chair has been detached from the rope and before it is re-attached to the rope. Any other combination suited to the type of installation can be implemented. The energy storage control device can be used for any other control, notably control of the guard-rail.

I claim:

1. A chair-lift having chair coupled on a line to an aerial rope and equipped with a swing-back protective hood, capable of occupying selectively two positions, a lower closed position protecting the passengers seated on the chair and a raised open position for the passengers to mount and dismount from said chair, a hood opening operation being performed at the entry to a terminal and a closing operation being performed at the exit from the terminal, wherein the chair comprises a first energy storage means for moving the hood from one of said positions to the other, a first catch inhibiting the action of said first energy storage means to hold the hood in said one position, said first catch being able to be unlatched to trigger an automatic movement of the hood to said other position due to the action of said first energy storage means, independently of the speed of the chair, and a reloading means of said first energy storage means, located in the terminal, for loading said first energy storage means during the passage of the chair through the terminal after said automatic movement of the hood to said other position, said reloading means not acting on said first catch.

2. A chair-lift according to claim 1, wherein said one position is the closed position of the hood and opening of the hood is triggered on entry to the terminal by unlocking of said first catch.

3. A chair-lift according to claim 1, wherein said reloading means of said first energy storage means is located in the terminal to reload the first energy storage means during the passage of the chair through the terminal.

4. A chair-lift according to claim 1, wherein the chair comprises a second energy storage means for moving the hood in the reverse direction from said other position to said one position and a second catch to hold the hood in said other position, said second catch being able to be unlatched to trigger an automatic reverse movement of the hood towards said one position due to the action of said second energy storage means and independently from the speed of the chair.

5. A chair-lift according to claim 4, wherein the first energy storage means is more powerful than the second energy storage means and the latter is reloaded by the movement of the hood controlled by said first energy storage means.

6. A chair-lift according to claim 5, wherein said first catch is unlocked when the chair enters the terminal to trigger opening of the hood by the action of first energy storage means and to bring about loading of the second energy storage means, the second catch holds the hood in the open position to allow reloading of the first energy storage means in the terminal and when the chair leaves the terminal the second catch is unlocked to trigger closing of the hood by the action of the second energy storage means and to hold the hood in the closed position.

7. A chair-lift according to claim 4, wherein the chair comprises a third safety catch locking the hood in the closed position, the third catch being unlocked before the first catch is unlocked.

8. A chair-lift according to claim 1, wherein the chair is detachable from the rope in the terminal and reloading of said first energy storage means is derived from the slow movement of the chair in the terminal in particular by the movement of a roller by a cam extending along a section of the trajectory of slow-speed travel of the chair.

9. A chair-lift according to claim 1, wherein the chair comprises a guard-rail capable of selectively occupying an open position and a closed position, and the hood cooperates with said guard-rail so that the guard-rail automatically moves to the open position when the hood is opened and to the closed position when the hood is closed.

10. A chair-lift according to claim 1, wherein the catches are automatically controlled when the chair passes predetermined locations, control of the catch triggering closing of the hood being able to be inhibited.

11. A chair-lift according to claim 1, wherein said first energy storage means is selected from the group consisting of a gravity device and a spring device.

* * * * *